US008444310B2

(12) United States Patent
Chen et al.

(10) Patent No.: US 8,444,310 B2
(45) Date of Patent: May 21, 2013

(54) LED MODULE WITH FAST DISASSEMBLY FUNCTION

(75) Inventors: Chang-Nan Chen, Shinjuang (TW); Teng-Sheng Hung, Shinjuang (TW); Jen-Yuan Hung, Shinjuang (TW)

(73) Assignee: Amphenol LTW Technology Co., Ltd., New Taipei (TW)

( * ) Notice: Subject to any disclaimer, the term of this patent is extended or adjusted under 35 U.S.C. 154(b) by 429 days.

(21) Appl. No.: 12/858,323

(22) Filed: Aug. 17, 2010

(65) Prior Publication Data

US 2012/0044685 A1 Feb. 23, 2012

(51) Int. Cl.

| | |
|---|---|
| ***H01R 33/00*** | (2006.01) |
| ***G12B 9/00*** | (2006.01) |
| ***F21S 4/00*** | (2006.01) |
| ***F21V 21/00*** | (2006.01) |

(52) U.S. Cl.

USPC ..... 362/640; 362/647; 362/240; 362/649; 362/249.02; 362/545; 248/27.1; 248/27.3

(58) Field of Classification Search

USPC ..... 362/652–659, 249.01–249.04, 382, 362/800, 217.01, 220, 224, 217.11–217.17, 362/227, 249.11, 372, 640, 646, 647; 248/27.1, 248/27.3; 411/45–48; 257/98–100

See application file for complete search history.

(56) References Cited

U.S. PATENT DOCUMENTS

| | | | | |
|---|---|---|---|---|
| 6,095,847 | A * | 8/2000 | Lin | 439/414 |
| 6,514,024 | B2 * | 2/2003 | Akema et al. | 411/48 |
| 6,979,162 | B2 * | 12/2005 | Kato | 411/371.1 |
| 7,385,285 | B2 * | 6/2008 | Wang | 257/712 |
| 7,429,186 | B2 * | 9/2008 | Mrakovich et al. | 439/404 |
| 2011/0073891 | A1 * | 3/2011 | Yen | 257/98 |

FOREIGN PATENT DOCUMENTS

JP 10339836 A * 12/1998

* cited by examiner

*Primary Examiner* — Mariceli Santiago

(74) *Attorney, Agent, or Firm* — Chun-Ming Shih; HDLS IPR Services

(57) ABSTRACT

A LED module with fast disassembly function is capable of being disassembled from a hole of a substrate by a tool and includes a lamp base, a LED and fasteners. The lamp base has tabs extending outwards. Each of the tabs is provided with a through-hole corresponding to the hole. The tab is formed with an inclined surface at the periphery of the through-hole. The LED is fixed on the lamp base. Each of the fasteners has a cap. The fastener is disposed through the hole and the through-hole to be fixed thereto. A notch is formed between the cap and the inclined surface. The tool is disposed in the notch to thereby disassemble the fastener from the hole and the through-hole. With this arrangement, the damaged LED can be detached from the substrate rapidly without replacing the whole LED module, thereby reducing the time and cost for maintenance.

14 Claims, 9 Drawing Sheets

LED MODULE WITH FAST DISASSEMBLY FUNCTION

BACKGROUND OF THE INVENTION

1. Field of the Invention

The present invention relates to a LED module, in particular to a LED module with fast disassembly function.

2. Description of Prior Art

Light emitting diode (LED) has many advantageous features, such as low consumption of electricity, long lifetime, small volume, and fast response time. Thus, LED has been widely used in lighting or light-emitting devices to replace traditional bulbs.

An advertising lamp-box constituted of LED modules is well known. Such an advertising lamp-box has vivid and changeable colors, so that it is more conspicuous than a traditional advertising lamp-box. The advertising lamp-box is made by arranging a plurality of LED in a matrix on a substrate to form a LED module. Then, the LED module is mounted in the advertising lamp-box.

If one or more LEDs break down and need to be replaced by new LED(s), such a LED module cannot allow the damaged LED to be replaced by a normal LED directly. Thus, it is necessary to detach the whole LED module from the advertising lamp-box and replace the damaged LED with normal LEDs. Finally, the repaired LED module is mounted again in the advertising lamp-box. Thus, such a procedure takes a lot of time and also increases the cost for maintenance.

Furthermore, in order to arrange more LEDs per unit area to increase the brightness of the LED module, these LEDs are arranged more densely on the substrate. Since the pitches between these LEDs are so small, only a tiny lateral space is available for disassembling the LEDs from the substrate. Thus, the only way is to assemble the LEDs on the substrate or disassemble the LEDs from the substrate through the obverse surface of the substrate.

Although a user may fix the LEDs on the substrate through the obverse surface of the substrate, using screws to fix the LEDs on the substrate really takes a lot of time. If self-tapping screws are used, the user needs to exert a larger force to drive the self-tapping screws in the substrate, which may cause the LEDs or the substrate to suffer damage in such a small pitch. If normal screws are used, it is necessary to provide corresponding screw holes on the substrate in advance, which increases the time for mounting the LEDs on the substrate and the production cost.

Thus, it is an important issue for the present Inventor to solve the above-mentioned problems.

SUMMARY OF THE INVENTION

The present invention is to provide a LED module with fast disassembly function, which allows the damaged LEDs to be fast disassembled from the substrate and replaced by new LEDs. Thus, it is unnecessary to replace the whole LED module to thereby reduce the time and cost for mounting the LEDs on the substrate.

The present invention provides a LED module with fast disassembly function, capable of being disassembled from a hole of a substrate by a tool and including:

a lamp base having at least one pair of tabs extending outwards, each of the pair of tabs being provided with a through-hole corresponding to the hole, the tab being formed with an inclined surface at the periphery of the through-hole;

a LED fixed on the lamp base; and a plurality of fasteners, each of the fasteners having a cap, the fastener being disposed through the hole and the through-hole to be fixed thereto, a notch being formed between the cap and the inclined surface, the tool being disposed in the notch to thereby disassemble the fastener from the hole and the through-hole.

The present invention provides a LED module with fast disassembly function, capable of being disassembled from a hole of a substrate by a tool and including:

a plurality of lamp bases arranged in a matrix on the substrate, each of the lamp bases having at least one pair of tabs extending outwards, each of the pair of tabs being provided with a through-hole corresponding to the hole, the tab being formed with an inclined surface at the periphery of the through-hole;

a plurality of LEDs fixed on the lamp bases respectively; and a plurality of fasteners, each of the fasteners having a cap, the fastener being disposed through the hole and the through-hole to be fixed thereto, a notch being formed between the cap and the inclined surface, the tool being disposed in the notch to thereby disassemble the fastener from the hole and the through-hole.

In comparison with prior art, the present invention has the following advantages:

According to the present invention, the lamp base has at least one pair of tabs extending outwards. Each of the tabs is provided with a through-hole to correspond to the hole of the substrate. The tab is formed with an inclined surface at the periphery of the through-hole. A notch is formed between the cap of the fastener and the inclined surface. Thus, an operator only needs to dispose a tool into the notch and exert a force on the cap, whereby the fastener can be rapidly removed from the through-hole and the hole. In this way, the lamp base with the LEDs fixed thereon can be rapidly disassembled from the substrate.

According to the above, in the present invention, if damaged LEDs are to be replaced, the operator only needs to insert the tool into the notch formed between the inclined surface of the lamp base having the damaged LED and the cap of the fastener and to exert a force to the cap. In this way, the fastener can be pulled out of the through-hole and the hole, and the lamp base having the damaged LEDs can be rapidly disassembled from the substrate, thereby reducing the time for assembly and maintenance.

Since the fasteners used in the present invention are rivets, it is faster and more cost saving to use the rivets in assembling the lamp bases with the substrate than to use traditional screws.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
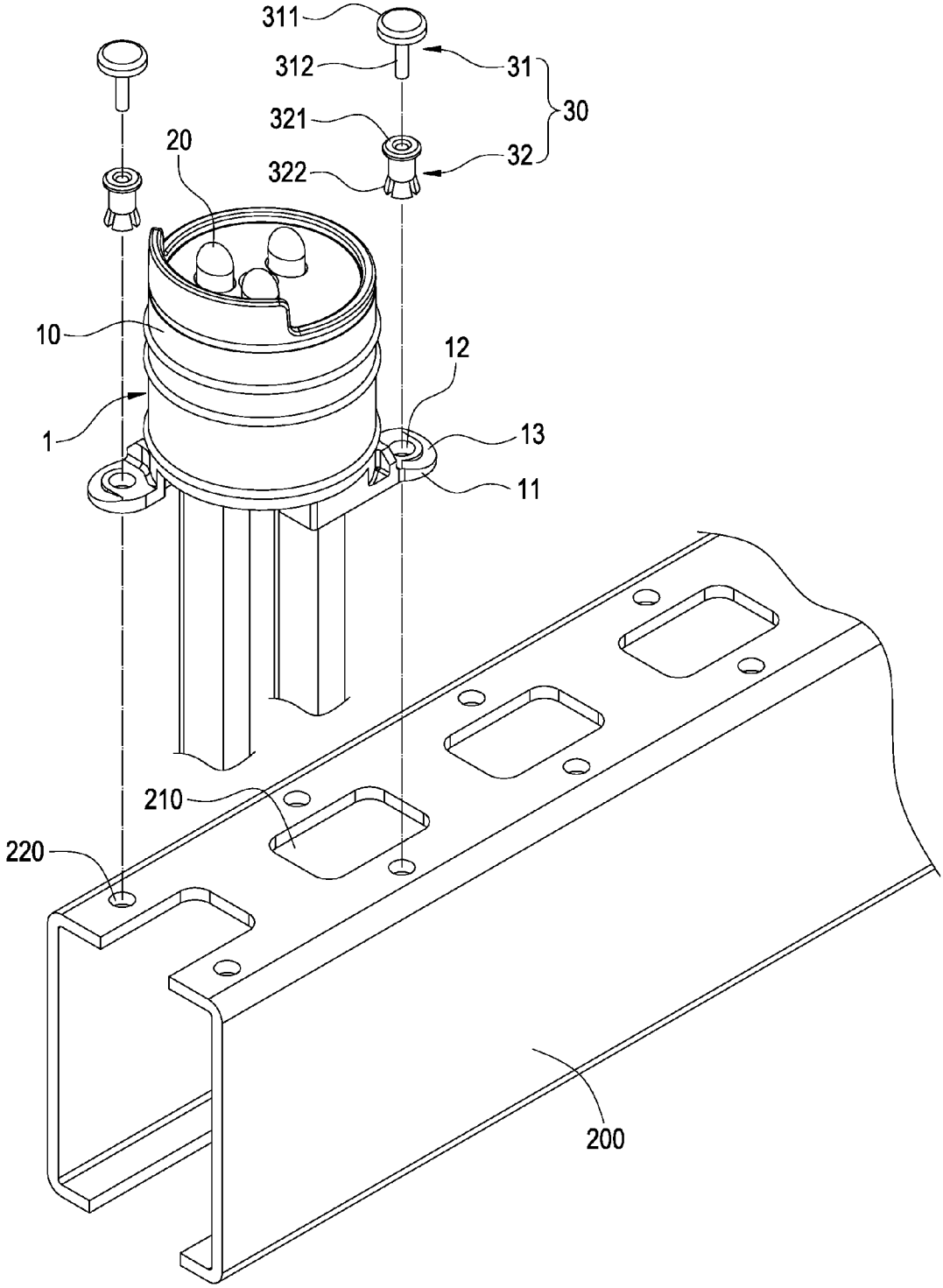
FIG. 1 is an exploded perspective view of the present invention.
Figure 2:
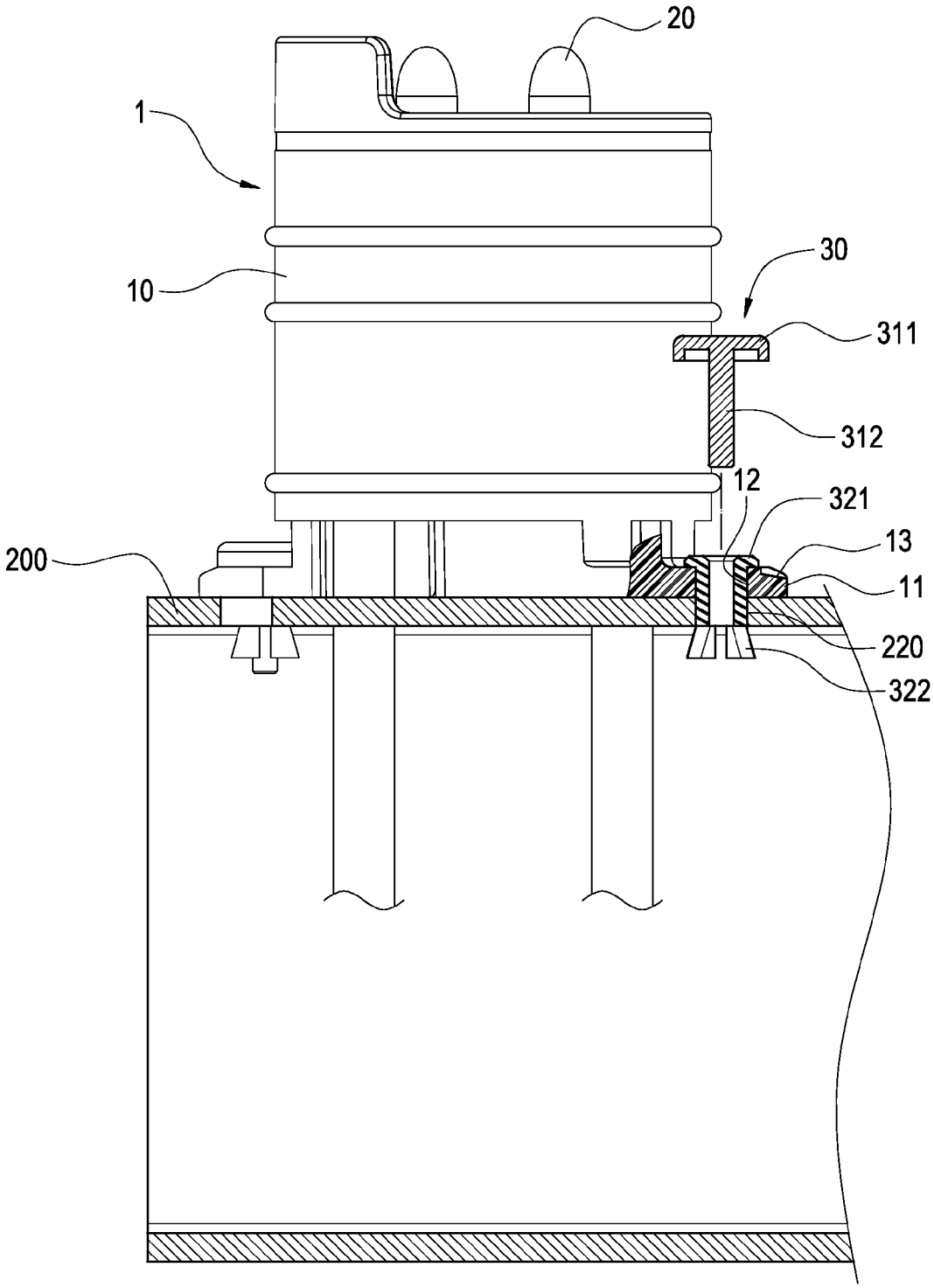
FIG. 2 is an assembled cross-sectional view of the present invention, showing that a fastener has not been inserted into a through-hole of a lamp base and a hole of a substrate.
Figure 3:
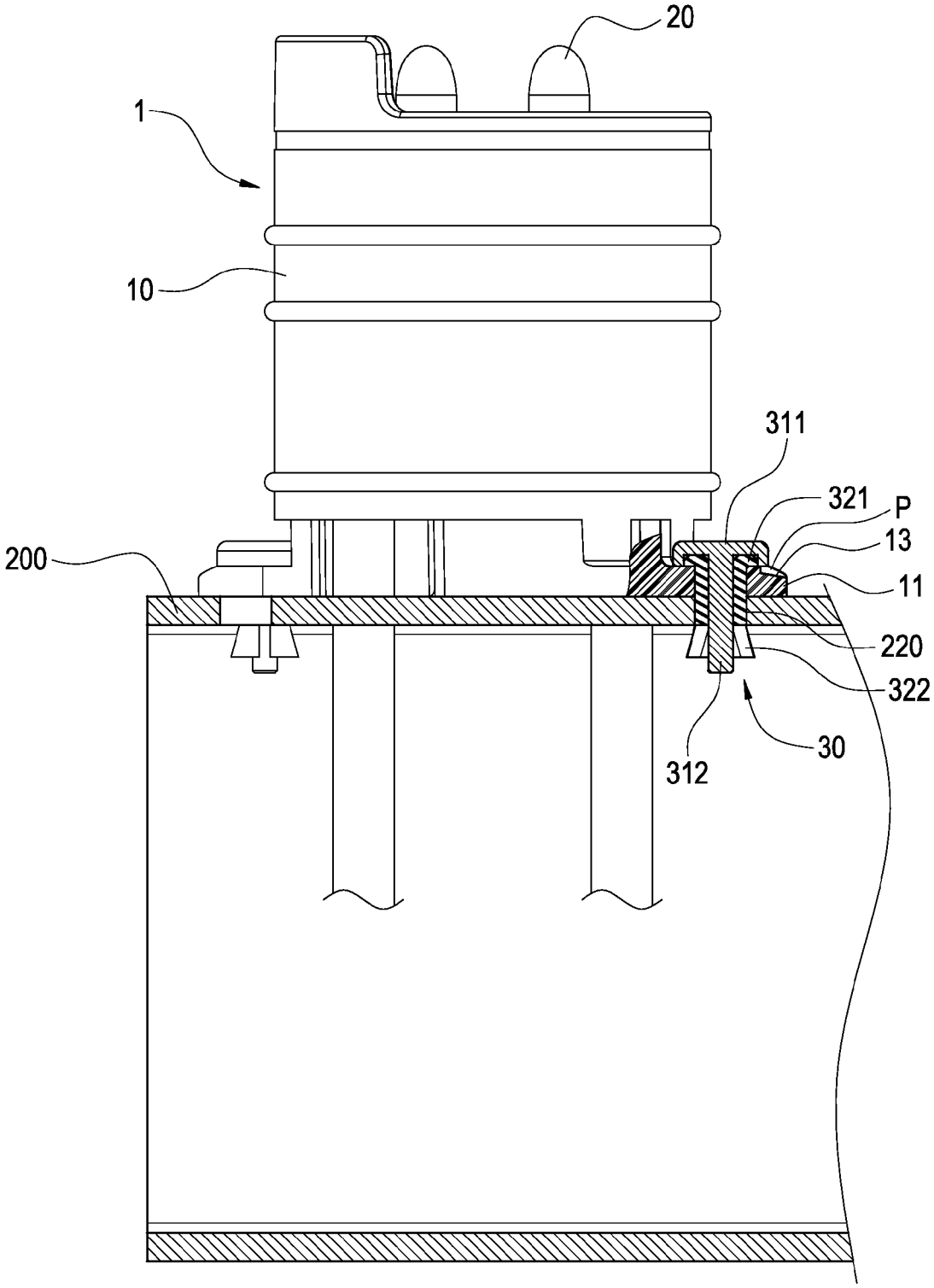
FIG. 3 is an assembled cross-sectional view of the present invention, showing that the fastener has been inserted into the through-hole of the lamp base and the hole of the substrate.

Please refer to FIGS. 1 to 3. The present invention provides a LED module with fast disassembly function (referred to as a "LED module 1" hereinafter), which is capable of being disassembled from a hole of a substrate 200 by a tool 100. The LED module 1 includes a lamp base 10, a LED 20 and a plurality of fasteners 30.

The substrate 200 is formed into a rectangular hollow body. One surface of the substrate 200 is provided with a plurality of mounting openings 210. The periphery of each of the mounting openings 210 is provided with two holes 220 opposite to each other.

The bottom of the lamp base 10 is provided with at least one pair of tabs 11 protruding outwards. The tab 11 is provided with a through-hole 12 located to correspond to the hole 220 of the substrate 200, so that the through-hole 12 of the tab 11 of the lamp base 10 can be aligned with the hole 220 at the periphery of the mounting opening 210 of the substrate 200. With this arrangement, the lamp base 10 can be mounted across the mounting opening 210 of the substrate 200.

The tab 11 is formed with an inclined surface 13 at the periphery of the through-hole 12. As shown in FIG. 1, the inclined surface 13 is located on an outer edge of the tab 11, so that the inclined surface 13 can be accessed from the outside of the tab 11.

LED 20 is fixed to the lamp base 10. Since the LED 20 is well known, the description thereof is omitted for simplicity.

The fastener 30 is disposed through the through-hole 12 and the hole 220 to thereby mount the lamp base 10 onto the substrate 200. In the present embodiment, a two-piece rivet is used as the fastener 30. That is, each of the rivets 30 includes a rivet body 31 and a sleeve 32 for allowing the rivet body 31 to be inserted therein. The rivet body 31 has a cap 311 and an insertion pin 312 extending downwards from the cap 311. The top of the sleeve 32 is provided with a flange 321 and the bottom of the sleeve 32 is formed with engaging legs 322. The gap between the engaging legs 322 is smaller than the inner diameter of the sleeve 32. Thus, when the rivet body 31 is inserted into the sleeve 32, the insertion pin 312 widens the gap between the engaging legs 322 outwards, thereby generating a radial engagement with the sleeve 32. At this time, the cap 311 of the rivet body 31 abuts against the flange 321 of the sleeve 32, so that the rivet body 31 cannot be inserted into the sleeve 32 to a deeper extent.

Please refer to FIG. 2. The sleeve 32 is disposed through the though-hole 12 of the lamp base 10 and the hole 220 of the substrate 200. Then, the rivet body 31 is inserted into the sleeve 32. The gap between the engaging legs 322 is widened by the insertion pin 312, so that the engaging legs 322 are engaged with the bottom of the hole 220 of the substrate 200. In this way, the lamp base 10 can be assembled with the substrate 200.

Please refer to FIG. 3. Since the tab 11 is formed with an inclined surface 13 at the periphery of the through-hole, a notch P is formed between the cap 311 and the inclined surface 13 when the fastener 30 passes through the though-hole 12 of the tab 11. The notch P is located on the outer edge of the tab 11.

Figure 4:
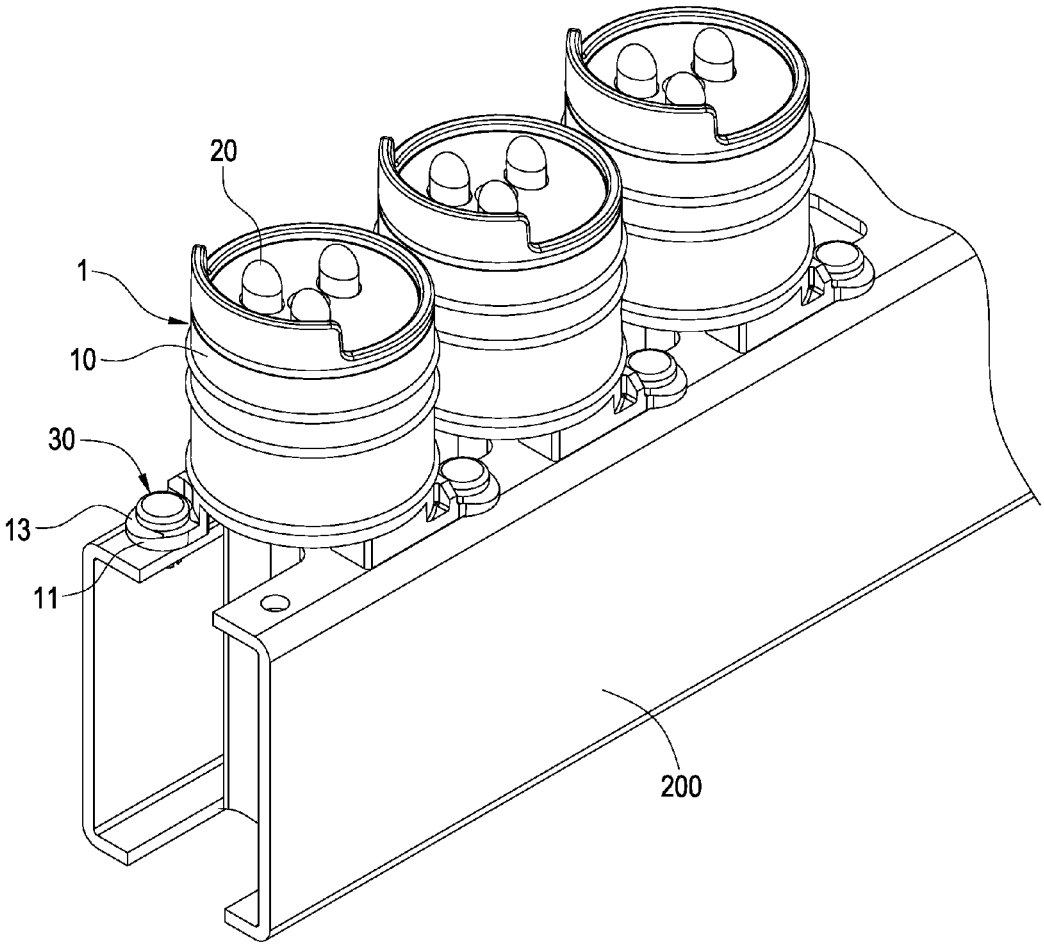
FIG. 4 is a schematic view showing one operating state of the present invention.
Figure 5:
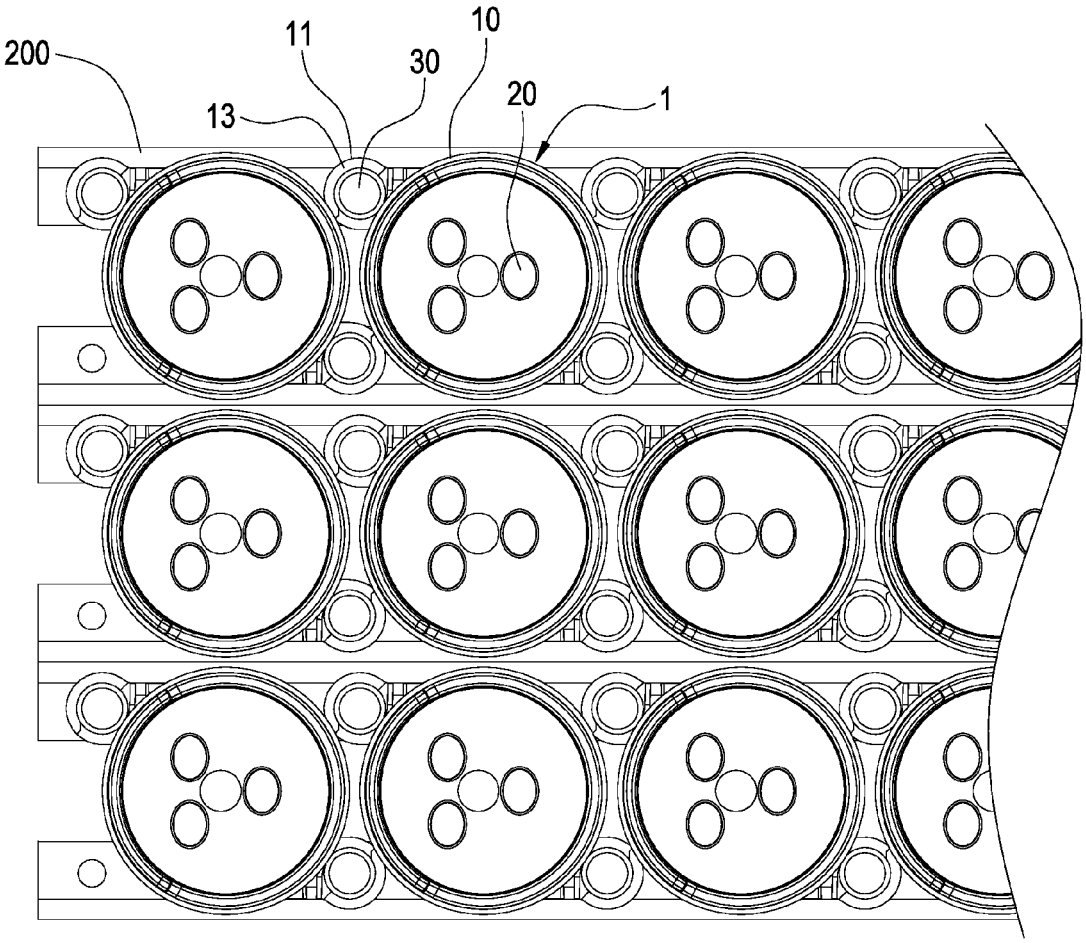
FIG. 5 is a schematic view showing another operating state of the present invention.

Please refer to FIGS. 4 and 5. FIG. 4 shows that one substrate 200 is assembled with a plurality of lamp bases 10 and the LEDs 20, while FIG. 5 shows that a plurality of substrates 200 is assembled with a plurality of lamp bases 10 and the LEDs 20. With this arrangement, the LED module 1 in which the lamp bases 10 and the LEDs 20 are arranged in a matrix can be obtained. FIG. 5 shows the tabs 11 of each lamp base 10 are arranged diagonally on the substrate 200. In other words, the tabs 11 are arranged in a gap between adjacent two circular lamp bases 10, thereby arranging maximum number of the lamp bases 10 per unit area.

Figure 7:
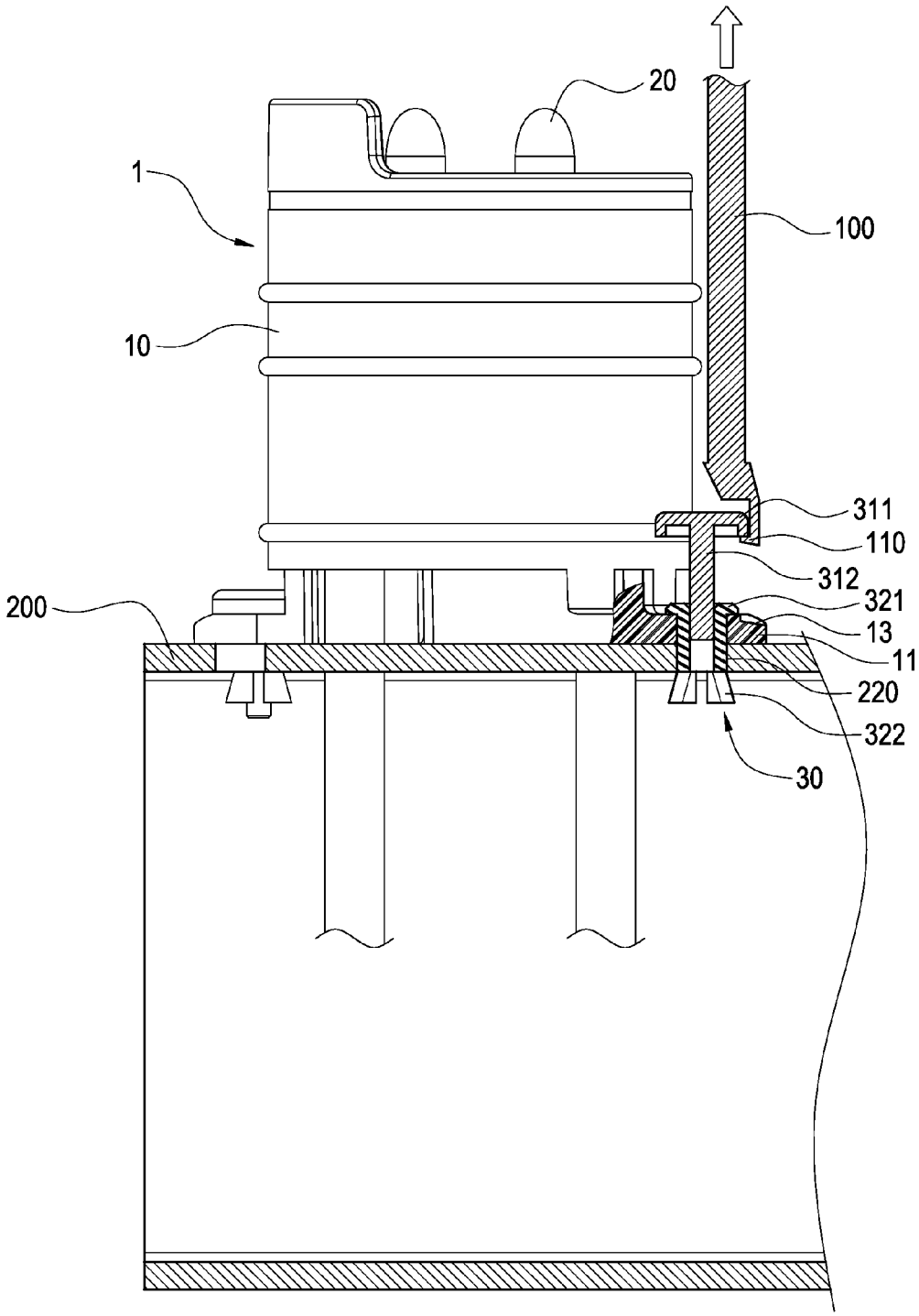
FIG. 7 is an assembled cross-sectional view of the present invention, showing that the tool has been used to remove the fastener from the through-hole of the lamp base and the hole of the substrate.
Figure 8:
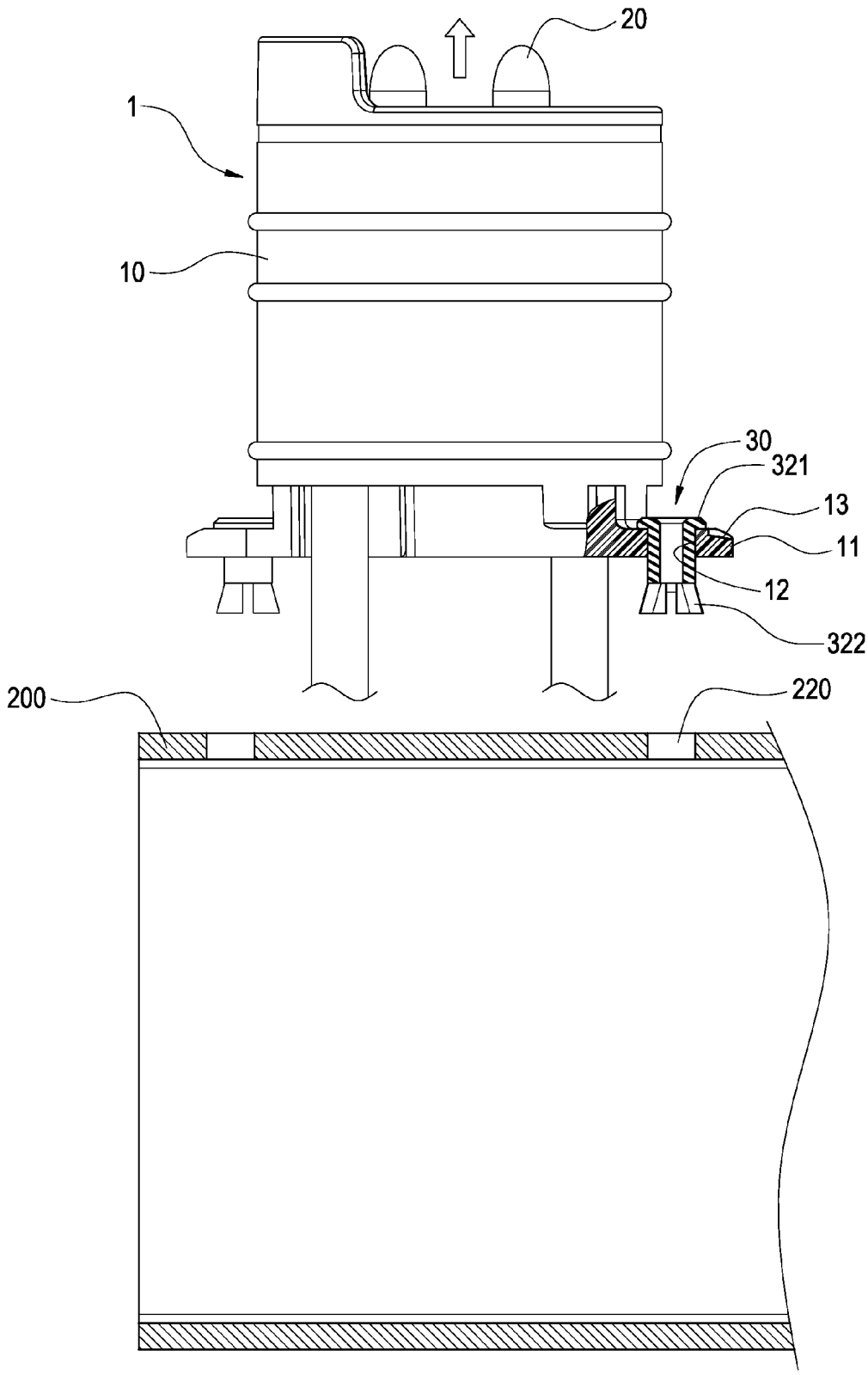
FIG. 8 is an assembled cross-sectional view of the present invention, showing that the lamp base has been disassembled from the substrate.

Next, with reference to FIGS. 6 to 8, the procedure of using a tool 100 to remove the fastener 30 from the lamp base 10 and then disassembling the lamp base 10 from the substrate 200 will be described as follows.

Figure 6:
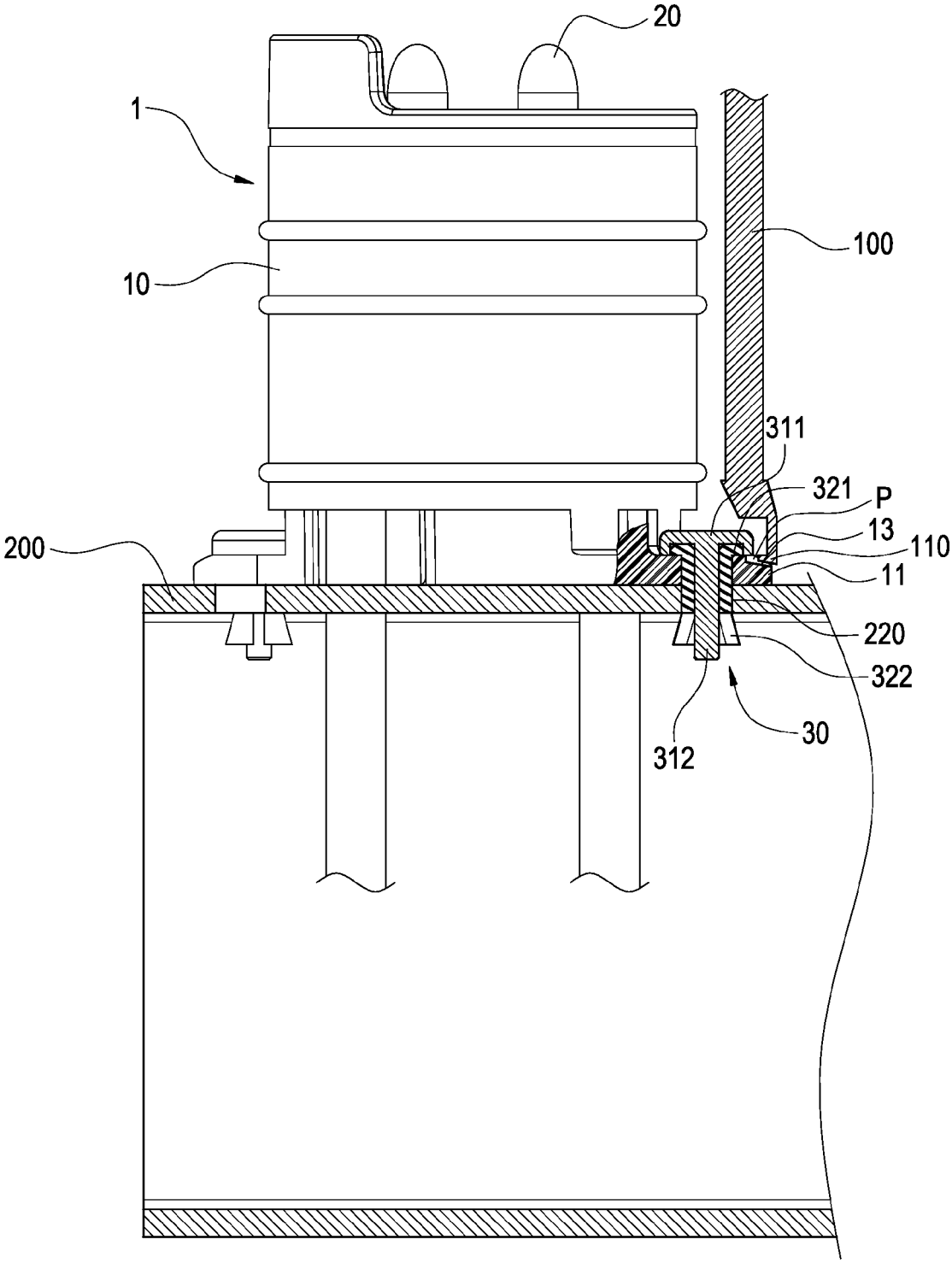
FIG. 6 is an assembled cross-sectional view of the present invention, showing that a tool is used to remove the fastener from the through-hole of the lamp base and the hole of the substrate.

As shown in FIG. 6, a user holds a tool 100. The distal end of the tool 100 is formed with a hook 110. The user inserts the hook 110 into the notch P formed between the cap 311 of the fastener 30 and the inclined surface 13 of the tab 11. Then, the user exerts a force to the cap 311 to thereby remove the rivet body 31 of the fastener 30 (i.e. the rivet) as shown in FIG. 7. Finally, the lamp base 10 can be disassembled from the substrate 200.

Figure 9:
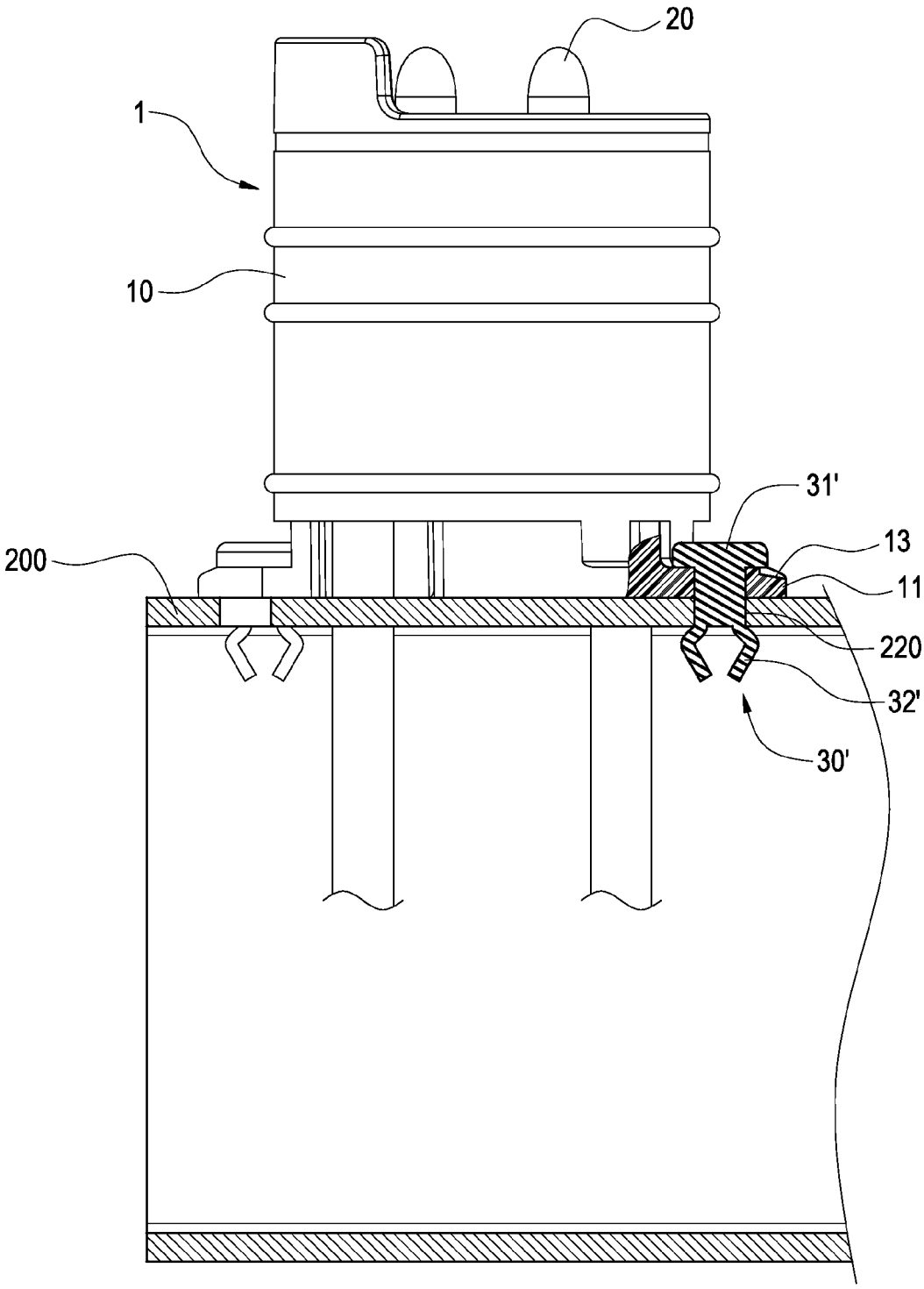
FIG. 9 is an assembled cross-sectional view of the present invention showing another embodiment of the fastener.

Although the two-piece rivet is used in the previous embodiment of the present invention, the fastener 30 of the present invention may be a one-piece rivet. As shown in FIG. 9, in the second embodiment of the present invention, the fastener 30' is a one-piece rivet, which has a cap 31' and a forked leg 32' extending downwards from the cap 31'. The cap 31' abuts against the top of the through-hole 12 of the tab 11. The forked leg 32' passes through the bottom of the hole 220 and is engaged therewith.

Although a pair of tabs 121 is used in the previous embodiment of the present invention, the number of the tabs 11, the through-holes 12 and the holes 220 is not limited thereto and can be varied according to practical demands. The above-mentioned embodiment merely illustrates a preferred mode for embodying the present invention, but not used to limit the scope of the present invention.

In comparison with prior art, the present invention has the following advantages:

According to the present invention, the lamp base 10 has at least one pair of tabs 11 extending outwards. Each of the tabs 11 is provided with a through-hole 12 to correspond to the hole 220 of the substrate 200. The tab 11 is formed with an inclined surface 13 at the periphery of the through-hole 12. A notch P is formed between the cap 311 of the fastener 30 and the inclined surface 13. Thus, an operator only needs to dispose a tool 100 into the notch P and to exert a force on the cap 311, whereby the fastener 30 can be rapidly removed from the through-hole 12 and the hole 220. In this way, the lamp base 10 with the LEDs 20 fixed thereon can be rapidly disassembled from the substrate 200.

According to the above, in the present invention, if the damaged LEDs 20 are to be replaced, the operator only needs to insert the tool 100 into the notch P formed between the inclined surface 13 of the lamp base 10 having the damaged LED 20 and the cap 311 of the fastener 30 and to exert a force to the cap 311. In this way, the cap 311 can be removed from the through-hole 12 and the hole 220, and the lamp base 10 having the damaged LEDs 20 can be rapidly disassembled from the substrate 200, thereby reducing the time for assembly and maintenance.

Since the fasteners 30 used in the present invention are rivets, it is faster and more cost-saving to use the rivets in assembling the lamp bases 10 with the substrate 200 than to use traditional screws.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A LED module with fast disassembly function, capable of being disassembled from a hole of a substrate by a tool and including:

a lamp base having at least one pair of tabs extending outwards, each of the pair of tabs being provided with a through-hole corresponding to the hole, the tab being formed with an inclined surface at the periphery of the through-hole so that an outer edge of the tab has a height smaller than that at the through-hole;

a LED fixed on the lamp base; and a plurality of fasteners, each of the fasteners having a cap, the fastener being disposed through the hole and the through-hole to be fixed thereto, a notch being formed between the cap and the inclined surface, the tool being disposed in the notch along the inclined surface to thereby disassemble the fastener from the hole and the through-hole.

2. The LED module with fast disassembly function according to claim 1, wherein the fastener is a two-piece rivet comprising a rivet body and a sleeve for allowing the rivet body to be inserted therein.

3. The LED module with fast disassembly function according to claim 2, wherein the rivet body has the cap and an insertion pin extending downwards from the cap, the top of the sleeve is formed with a flange, the bottom of the sleeve has a plurality of engaging legs, the sleeve passes through the though-hole and the hole in such a manner that the flange abuts against the top of the through-hole and the engaging legs are elastically engaged with the bottom of the hole.

4. The LED module with fast disassembly function according to claim 2, wherein the pair of tabs is located on both sides of the lamp base.

5. The LED module with fast disassembly function according to claim 1, wherein the fastener is a one-piece rivet comprising the cap and a forked leg extending downwards from the cap, the cap abuts against the top of the through-hole, and the forked leg is elastically engaged with the bottom of the hole.

6. The LED module with fast disassembly function according to claim 5, wherein the pair of tabs is located on both sides of the lamp base.

7. A LED module with fast disassembly function, capable of being disassembled from a hole of a substrate by a tool and including:

a plurality of lamp bases arranged in a matrix on the substrate, each of the lamp bases having at least one pair of tabs extending outwards, each of the pair of tabs being provided with a through-hole corresponding to the hole, the tab being formed with an inclined surface at the periphery of the through-hole so that an outer edge of the tab has a height smaller than that at the through-hole;

a plurality of LEDs fixed on the lamp bases respectively; and a plurality of fasteners, each of the fasteners having a cap, the fastener being disposed through the hole and the through-hole to be fixed thereto, a notch being formed between the cap and the inclined surface, the tool being disposed in the notch along the inclined surface to thereby disassemble the fastener from the hole and the through-hole.

8. The LED module with fast disassembly function according to claim 7, wherein the fastener is a two-piece rivet comprising a rivet body and a sleeve for allowing the rivet body to be inserted therein.

9. The LED module with fast disassembly function according to claim 8, wherein the rivet body has the cap and an insertion pin extending downwards from the cap, the top of the sleeve is formed with a flange, the bottom of the sleeve has a plurality of engaging legs, the sleeve passes through the though-hole and the hole in such a manner that the flange abuts against the top of the through-hole and the engaging legs are elastically engaged with the bottom of the hole.

10. The LED module with fast disassembly function according to claim 9, wherein the pair of tabs is located on both sides of the lamp base.

11. The LED module with fast disassembly function according to claim 9, wherein the lamp base is formed into a circular shape, the pair of tabs of any one of the lamp bases is located in a gap formed between adjacent lamp bases.

12. The LED module with fast disassembly function according to claim 7, wherein the fastener is a one-piece rivet comprising the cap and a forked leg extending downwards from the cap, the cap abuts against the top of the through-hole, and the forked leg is elastically engaged with the bottom of the hole.

13. The LED module with fast disassembly function according to claim 12, wherein the pair of tabs is located on both sides of the lamp base.

14. The LED module with fast disassembly function according to claim 13, wherein the lamp base is formed into a circular shape, the pair of tabs of any one of the lamp bases is located in a gap formed between adjacent lamp bases.

* * * * *